US005487240A

United States Patent [19]

Miller

[11] Patent Number: 5,487,240

[45] Date of Patent: Jan. 30, 1996

[54] COMPACT SLEEPING UNIT

[76] Inventor: Frederick H. Miller, 3627 Hillside Ave., Cincinnati, Ohio 45204

[21] Appl. No.: 342,354

[22] Filed: Nov. 18, 1994

Related U.S. Application Data

[63] Continuation-in-part of Ser. No. 134,007, Oct. 12, 1993.

[51] Int. Cl.[6] ..... E04H 3/04

[52] U.S. Cl. ..... 52/33; 52/36.4; 52/79.8

[58] Field of Search ..... 52/34, 36.4, 36.5, 52/33, 79.1, 79.2, 79.7, 79.4, 79.8, 204.62, 236.3, 236.9

[56] References Cited

U.S. PATENT DOCUMENTS

| | | | |
|---|---|---|---|
| 3,784,989 | 1/1974 | LeGrand . | |
| 4,071,210 | 1/1978 | Mutke . | |
| 4,102,091 | 7/1978 | Farge | 52/79.7 |
| 4,327,529 | 5/1982 | Bigelow, Jr. et al. | 52/34 |
| 4,332,681 | 6/1982 | Jambry et al. | 52/34 X |
| 4,594,817 | 6/1986 | McLaren et al. . | |
| 4,744,182 | 5/1988 | Shacket et al. | 52/79.1 X |
| 4,811,530 | 3/1989 | Eyerly | 52/79.1 X |
| 4,823,529 | 4/1989 | Canfield et al. | 52/79.2 X |
| 4,866,833 | 9/1989 | Ward | 52/79.8 X |
| 5,111,626 | 5/1992 | Fortune | 52/79.1 |
| 5,193,325 | 3/1993 | Allison . | |
| 5,224,305 | 7/1993 | Kassai | 52/79.1 X |
| 5,265,384 | 11/1993 | Menke et al. | 52/79.1 |
| 5,317,857 | 6/1994 | Allison . | |
| 5,335,614 | 8/1994 | Klaus | 52/79.1 X |

FOREIGN PATENT DOCUMENTS

| | | | |
|---|---|---|---|
| 295087 | 6/1965 | Australia | 52/34 |
| 5287919 | 11/1993 | Japan | 52/34 |

*Primary Examiner*—Lanna Mai

*Attorney, Agent, or Firm*—Wood, Herron & Evans

[57] ABSTRACT

A compact sleeping unit is provided which can be mated with similarly configured sleeping units to form a grouping for use in a wide range of situations and settings. Each unit includes a horizontal platform and mattress for the compact sleeping of an occupant and a vertically oriented area for dressing and changing which is accessible to each sleeping area through a passage. The compact sleeping unit of the present invention provides a safe, clean, secure, private, inexpensive, portable and easily erected structure to service humans in a wide range of applications.

29 Claims, 2 Drawing Sheets

COMPACT SLEEPING UNIT

This is a continuation-in-part of patent application Ser. No. 08/134,007 filed Oct. 12, 1993.

BACKGROUND OF THE INVENTION

This invention relates to structures for human habitation, and more particularly, to a compact, portable sleeping unit.

Throughout history, many different structures have been built for human habitation. Structural design and integrity, size, cost, and mobility are some of the factors which vary among the numerous types of structures suitable for human habitation. For example, structures can range from very expensive and large inner-city apartment buildings to standard suburban one or two story brick or frame houses to canvas tents.

Some human habitable structures are relatively compact in size and inexpensive. Examples of such compact habitable structures include private births in railroad cars or cot-sized, coin operated sleeping compartments in airports.

Frequently, temporary structures are required to accommodate disaster victims, refugees, injured or sick people, or homeless people. Optimally, such structures should offer privacy, safety, security, cleanliness and be inexpensively manufactured, portable and quickly and easily erected. Very often, open communal shelters located in huge halls, gymnasiums or other open spaces are used to accommodate large numbers of people. However, the accommodations in such halls or gymnasiums do not offer the occupants privacy, security, or adequately comfortable living or sleeping arrangements. In other settings, tents or like structures are often used in refugee camps, penal institutions, migrant work farms or the like. However, tents also do not provide for adequate security and are preferably used only in clement weather conditions.

As evidenced from the above discussion, there is a need for a structure capable of human habitation which is safe, secure, private, portable, inexpensive, clean and readily adaptable for a variety of uses and conditions.

SUMMARY OF THE INVENTION

It has been a primary objective of this invention to provide a compact structure suitable for human habitation which includes a sleeping unit and a dressing or other area.

It has been a further objective to provide such a structure which is low cost and can be arranged with other similar units to provide accommodations for a maximum number of people in a minimum amount of space.

It has been a further objective of this invention to provide such a structure that can be inexpensively and easily manufactured and erected for use in a wide range of locations, terrains or climates.

It has been a still further objective of this invention to provide such a structure so that an occupant requiring medical assistance is readily accessible to a care giver with or without entering the structure.

These and other objectives of the invention have been obtained by a compact sleeping unit which includes separate compartments each having sleeping and dressing areas. The present invention provides a solution to a number of problems involving health, safety, housing and general welfare. The invention is modular and can be produced at extremely low cost to provide private bed and living space at temporary shelters and in institutional settings. Occupants are provided with a private, safe, and secure sleeping area in well-lighted, heated and ventilated space. In addition to a bed, occupants are provided with a small but effective dressing and sitting area complete with a folding seat and/or table. The privacy, safety and security afforded the occupant is a vast improvement over open communal shelters and camp-like environments.

The present invention is also ideally suited for temporary medical care facilities in that the occupant can be attended to by a care giver or other medical professional through an access panel adjacent to the bed. In addition, the access panel also offers a convenient way out of the unit for the occupant.

The basic structure of this invention could be used in combination with a plurality of similarly configured structures to provide accommodations for a vast number of people in a minimum amount of space. The present invention can be used inside of existing buildings such as warehouses or gymnasiums, on inner-city lots, suburban and rural locations, or otherwise uninhabitable settings. The invention can be used in a variety of different situations including temporary housing for homeless people, peace corps workers, environmental field workers, migrant laborers, military personnel, penal institution inmates, students or participants in training or educational programs, and refugees from natural and man-caused disasters.

Additionally, the present invention can be employed as part of the health care delivery system for sick people, especially those with highly contagious diseases, in that the occupant is isolated from other occupants and can be attended to from outside of the unit through an access panel. Also, the units could be used for recreational sleeping facilities in that a safe, comfortable, private sleeping area is provided.

The compact sleeping units of this invention could be used in association with other auxiliary services which include toilets, showers, work space, food service, healthcare, exercise and recreational activities. The present invention is portable and constructed at very low cost from modular, prefabricated and/or panelized construction materials. Structural insulated panels with impervious surfaces permitting washing of the units are also contemplated. Each unit according to a presently preferred embodiment of this invention is a totally integrated combination of structural panels and/or walls, except for the doors, windows or the like, to provide for a stable, secure structure.

The present invention includes a generally vertical, rectangular cell having an internal volume of sufficient size for a person to stand upright therein in order to change clothes, stretch, relax, or use a collapsible table and/or chair provided therein. Connected to each vertical cell is a generally horizontal cell having a platform and mattress thereon to form a bed, and being sufficiently large for a person to recline or lie down. The two portions, are connected in a side-by-side, perpendicular configuration and a passage or opening is provided therebetween. A doorway and a door are provided to offer access to the vertical cell and an access panel or opening is provided on an exterior sidewall adjacent the bed to provide access to the person lying thereon from outside of the unit or an added means for the occupant to enter/exit the unit, especially in case of emergency.

The structure according to this invention can be uniquely mated with similarly configured structures to offer accommodations for a number of occupants. Each occupant has an individualized and separate sleeping and changing area. A pair of units are mated together such that the sleeping areas are positioned atop one another and the respective dressing/sitting areas are at a common side of the beds and adjacent one another on one horizontal plane.

BRIEF DESCRIPTION OF THE DRAWINGS

The numerous features and advantages of the invention will become more readily apparent from the following detailed description taken in conjunction with the drawings in which.

DETAILED DESCRIPTION OF THE INVENTION

Figure 1:
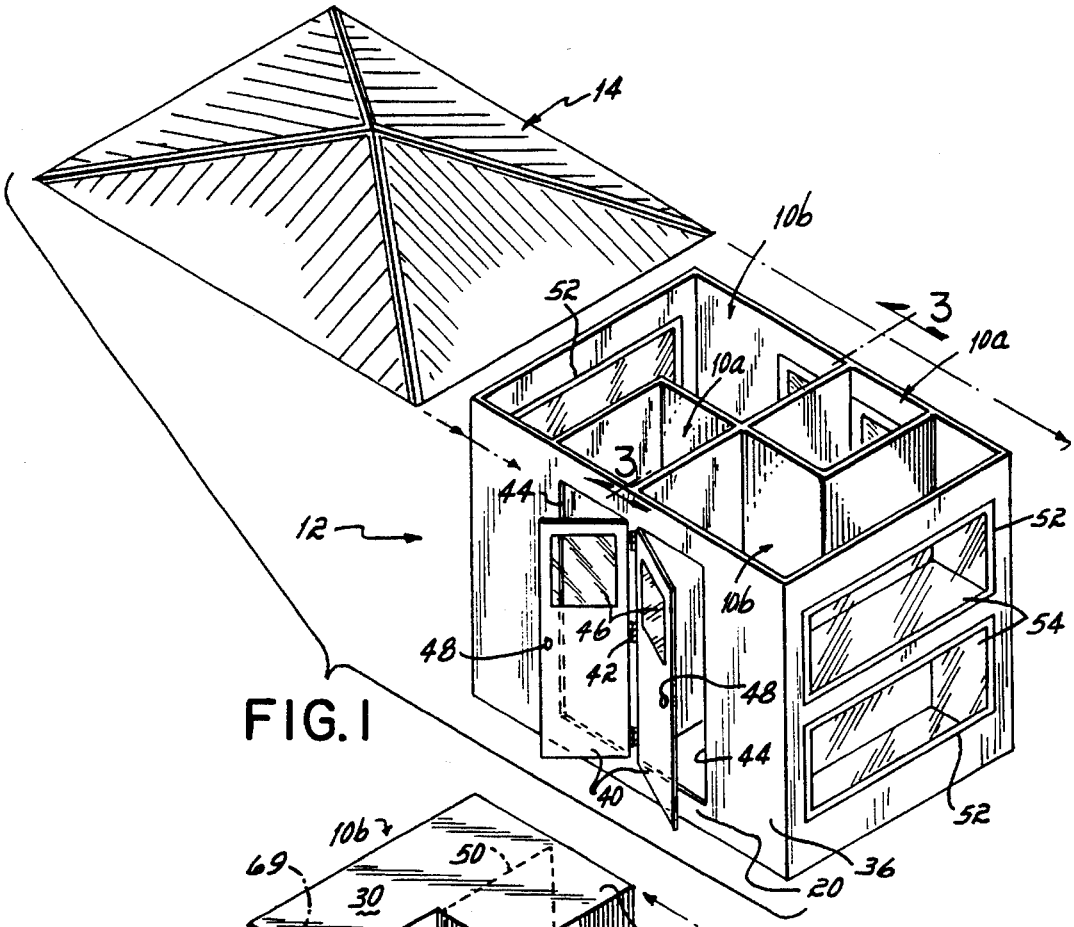
FIG. 1 is a partially disassembled perspective view of a grouping of four compact sleeping units with a roof according to the present invention.
Figure 2:
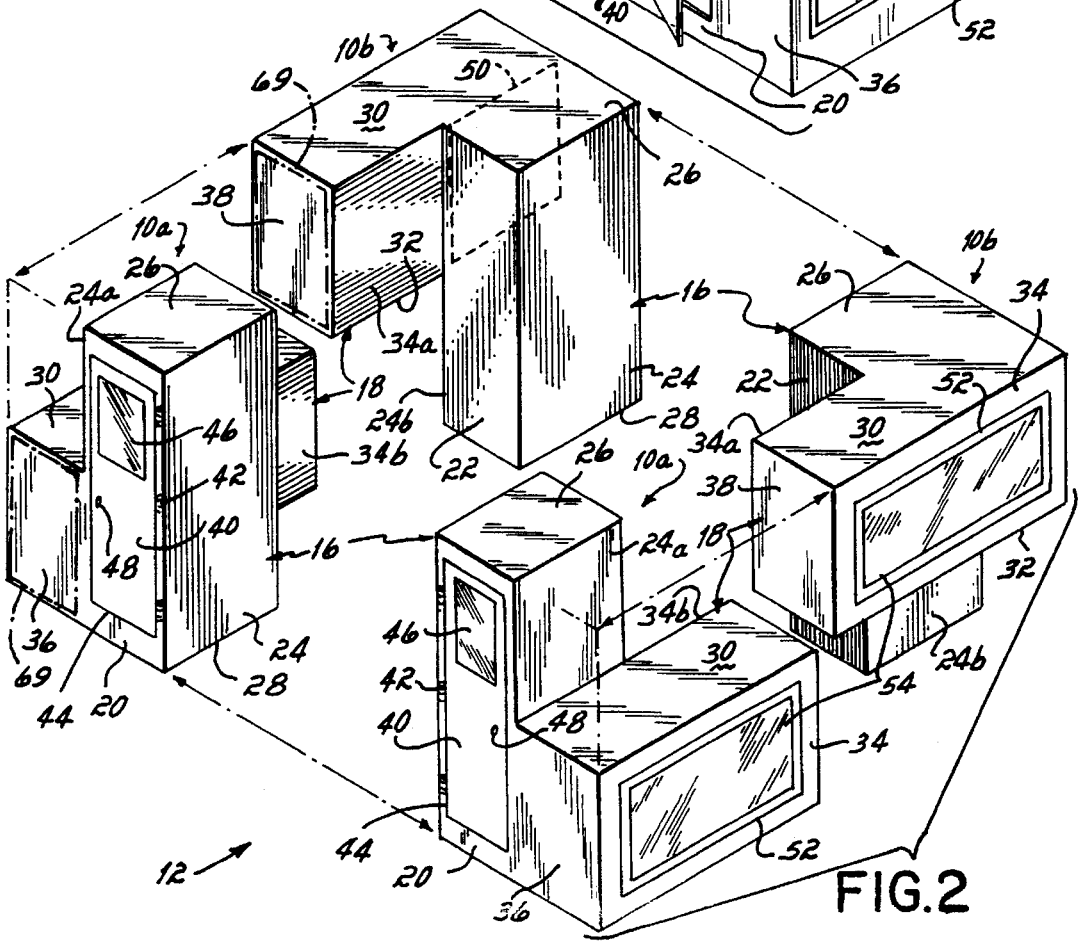
FIG. 2 is an exploded perspective view of the spatial relationship of four compact sleeping units of this invention forming a grouping.

FIG. 1 shows four compact sleeping units according to this invention assembled to form a grouping 12. The grouping 12 includes two compact sleeping units of a first type 10*a* and two units of a second type 10*b*. The differences between the two types of units 10*a*, 10*b* will be described later herein. Covering the grouping 12 is a roof 14. The spatial relationship of the four individual units forming the grouping 12 is shown in FIG. 2. Each compact sleeping unit 10*a* or 10*b* according to this invention includes a generally rectangular, vertically oriented cell 16 connected to a generally rectangular, horizontally oriented cell 18. Each vertical cell 16 is sufficiently large for a human occupant to stand upright therein, preferably of at least seven feet internal height. Each vertically oriented cell 16 includes a front 20 and a back wall 22, a pair of opposing sidewalls 24 and either 24*a* or 24*b*, and a ceiling 26 and a floor 28. Similarly, each horizontal cell includes a ceiling 30 and a floor 32, a pair of opposed sidewalls 34 and either 34*a* or 34*b*, and a front 36 and back 38 wall. The front and back walls of the horizontal and vertical cells are all either generally parallel or coplanar with respect to each other. Similarly, the sidewalls of the horizontal and vertical cells are all either generally parallel or coplanar with respect to each other.

A door 40 is pivotally connected as by hinges 42 within a doorway 44 on the front wall 20 of each unit 10*a* or 10*b*. The door 40 preferably includes a window 46 and a door knob 48. Preferably the door 40 includes a lock or other means for preventing entry to provide privacy and security to the occupant. The vertical cell 16 and horizontal cell 18 of each unit 10*a* or 10*b* are connected so that the cells are adjacent and perpendicular with respect to each other as shown in FIG. 2 and have a passage or opening 50 therebetween positioned on a surface common to the adjacent sidewalls 24*a* and 34*b* or 24*b* and 34*a*. Occupants of the unit 10*a* or 10*b* can pass between the cells 16, 18 through the opening or passage 50. In the unit of a first type 10*a*, the horizontal cell 18 is attached at the lower end of the sidewall 24*a* to the wall 34*b* of vertical cell 16 and in a unit of the second type 10*b* the horizontal cell 18 is attached at the upper end of the sidewall 24*b* to the wall 34*a* of vertical cell 16. The first and second types of units 10*a*, 10*b* are complementary to each other. The units 10*a* and 10*b* in the grouping 12 can be identically constructed as shown in FIG. 1, or can be constructed as mirror images as shown in FIG. 2.

The sidewall 34 of each horizontal cell 18 opposite from sidewall 34*a* or 34*b* which is connected to the vertical cell 16 includes an opening 52. The opening 52 is preferably enclosed with a closure, window or access panel 54 fitted to the opening 52. The access panel 54 can be opaque, transparent or translucent with fixed or venting glass or plastic openings, but is preferably at least partially translucent. Preferably, the access panel 54 is pivotally coupled along an upper edge of the opening 52 and can be converted to and between open and closed positions.

A unit of the first type 10*a* and a unit of the second type 10*b* are mated together to form a block 56 of compact sleeping units according to this invention. The units 10*a*, 10*b* are mated together such that the back walls 22 of the vertical cells 16 of the units are juxtaposed with respect to each other, the ceiling 30 of the horizontal cell 18 of the first type unit 10*a* is juxtaposed to the floor 32 of the horizontal cell 18 of the second type unit 10*b* and the access panels 54 of the units are facing in the same direction and positioned one atop another as shown in FIGS. 1 and 2.

It will be appreciated by one of ordinary skill in the art that although the respective walls of each unit 10*a* or 10*b* are described herein and shown in FIG. 2 as being separate from the walls of a complementary unit for forming the block 56, the juxtaposed walls of the units could, and preferably are, a single wall according to this invention and the appended claims. Specifically, the back wall 22 of the vertical cells 16 of complementary units 10*a* and 10*b* in the block are preferably a single wall or partition for separating the dressing areas of units 10*a* and 10*b*. Similarly, the ceiling 30 and floor 32 of the horizontal cells 18 of complementary units 10*a* and 10*b* are a single wall or partition. Furthermore, the common walls of the complementary units 10*a* and 10*b* provide an interlocking arrangement of structural panels for joining the units 10*a* and 10*b* together.

A pair of blocks 56, 56 formed from sleeping units of the first and second type 10*a* and 10*b*, respectively, are mated together to form the grouping 12. The blocks 56 are mated together so that the access panels 54 on the horizontal cells 18 of each block 56 face in opposite directions and the doors 40 on the vertical cells 16 of each block 56 are side-by-side with respect to each other.

Figure 3:
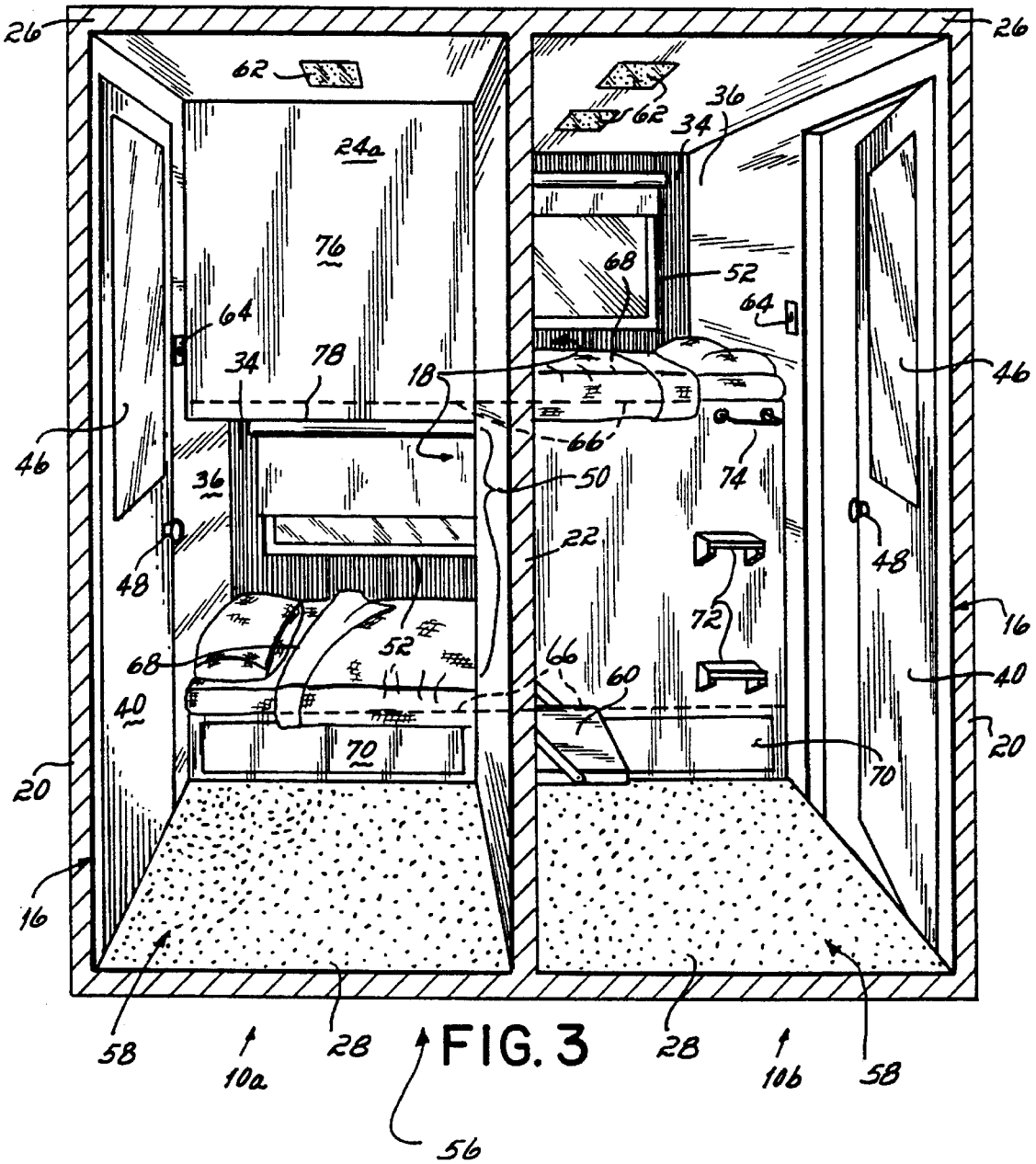
FIG. 3 is a cross-sectional side view taken along line 3—3 of FIG. 1 of the internal space of two compact sleeping units of this invention.

Referring to FIG. 3, a dressing/sitting area 58 is provided within the vertical cell 16 of each unit 10*a* or 10*b* and may include a collapsible chair and/or table 60 secured to a wall surface within the dressing/sitting area 58. In addition, electrical lights 62 operable by a switch 64 are preferably provided within each unit. Electricity is supplied to the units in any conventional manner as is understood by one of ordinary skill in the art. A platform 66 is provided within the horizontal cell 18 of each unit 10*a* or 10*b* and includes a mattress and bedding 68 supported thereon to provide a comfortable, convenient place for the occupant to recline and sleep.

An optional feature of the invention includes a port 69, door, access panel or the like (shown in phantom outline in FIG. 2) located on the front 36 and/or back 38 wall of the horizontal cell 18 to slide, roll or otherwise move the platform 66 through in order to exit and/or enter the cell 18. A cot or stretcher (not shown) may be positioned atop the platform 66, or incorporated therewith, for convenient movement of a patient or occupant of the unit thereon through the port 69.

A storage compartment or drawer 70 may preferably be provided beneath the platform 66 for the storage of personal belongings or other items as shown in FIG. 3. Additionally, steps 72 or handholds 74 may optionally be provided to offer convenient access to the platform 66 and mattress 68 within the compact sleeping unit of the second type 10*b*. It will be appreciated by one of ordinary skill in the art that access from outside of the unit 10*a* or 10*b* is available to a person reclining on the platform 66 and mattress 68 through the opening 52 and access panel 54 when in the open configuration. Similarly, the opening 52 and access panel 54 offer a way into and/or out of the units 10*a* or 10*b* for the occupant.

In a presently preferred embodiment of the present invention, a panel 76 or portion of the sidewall 24*a* of the vertical cell 16 of unit 10*a* adjacent the portion of the sidewall 34*a* of the horizontal cell 18 can be pivotally hinged along an edge 78 thereof. As a result, the panel 76 could be secured to a closed position as shown in FIG. 3 or the panel 76 could be pivoted about its edge 78 to thereby provide access to the horizontal cell 18 of the adjoining unit 10*b* within the block 56 from the vertical cell 16 of the complementary unit 10*a*. However, pivoting the panel 76 to the open position closes off the passage 50 providing access between the vertical 16 and horizontal 18 cells of the unit 10*a*. In a still further feature, the panel 76 may be constructed of a roll-type closure which can be recessed beneath the platform 66 thereby offering access to both horizontal cells 18 of the block 56 from the vertical cell 16 to which the panel 76 is accessible.

Another feature of the invention, which may be required depending upon the application, is a pier or other pylon (not shown) positioned beneath the grouping 12 to stabilize and level the respective units 10*a* or 10*b*. A pier suitable for such purposes is commercially available from Sure Safe Industries, Inc. and marketed as a High Technique Pier. The pier and roof 14 are optional, particularly if the invention is to be used indoors as in a warehouse or the like.

Each grouping 12 measures approximately 7 feet, 4 inches wide, 12 feet long and 8 feet high on the exterior, though these dimensions may vary as the circumstances require. The preferred means of constructing the units 10*a* or 10*b* according to this invention include modular, prefabricated and panelized methods as understood by one of ordinary skill in the construction art. The compact sleeping units of this invention can be built from a variety of materials in each method. Preferably, structural insulated panels with impervious surfaces permitting washing out of the units with waterhoses are used. Structural insulated panels arc well known in the art and include various materials. Preferably, the structural insulated panels of this invention comprise a pair of panels of plywood with a rigid foam material sandwiched therebetween. The structural insulated panels are preferably 4½" thick and are made from a pair of ½" plywood skins between which is sandwiched an insulated foam core. The entire panel is laminated together to provide increased load bearing capacity. Other panel configurations and constructions could be used within the scope of this invention.

The roof 14 positioned atop each grouping is preferably a prefabricated roof designed to nest with similar roofs for optimum efficiency during transportation and shipping. The roof 14 could also be in half or quarter sections for shipping purposes and then assembled into a complete roof unit for use. In addition, a patio enclosure (not shown) or similar structure could be provided on the exterior of the grouping 12 to enclose the access panels 54 as an optional feature to the present invention. Other features and advantages of the present invention are discussed in co-pending application Ser. No. 08/134,007, which is hereby incorporated by reference.

It will be appreciated by one of ordinary skill in the art that the compact sleeping unit of the present invention is susceptible to many uses and modifications which should be considered within the scope of the present invention. For example, groupings 12 of four units could readily be configured and arranged for multi-story accommodations which may include outdoor, covered multipurpose use areas between the groupings 12. Family-type units could be constructed with the present invention by omitting the common back wall 22 of mated units 10*a* and 10*b* and/or other common walls or partitions between the units 10*a* and 10*b* or the units within a block 56 or grouping 12.

Furthermore, auxiliary facilities such as plumbing, food service and recreational accommodations can be incorporated into the complex of sleeping units 10*a* or 10*b* according to this invention. As a result, the compact sleeping unit of the present invention provides a convenient, safe, secure, private, durable, inexpensive, portable, and readily available sleeping area with an accessible dressing and changing area.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof.

I claim:

1. A structure suitable for human habitation comprising:

a generally rectangular, vertically oriented cell, said vertical cell having a back wall spaced from a front wall and a pair of spaced side walls, said vertical cell having an internal volume of sufficient size for a person to stand upright therein;

a generally rectangular, horizontally oriented cell, said horizontal cell having a ceiling spaced from a floor and a pair of spaced side walls, said horizontal cell having an internal volume of sufficient size for the person to recline therein;

a platform in said horizontal cell upon which the person can recline;

said horizontal and vertical cells being connected to form a unit so that a portion of one of said horizontal cell side walls is juxtaposed to a portion of one of said vertical cell side walls; and a passage between said cells through which the person can move to and between said cells.

2. The structure of claim 1 further comprising:

a doorway and a door on said vertical cell front wall through which the person can enter and exit said unit.

3. The structure of claim 1 further comprising:

an opening on said horizontal cell side wall opposite from said horizontal cell side wall which is juxtaposed to said vertical cell, said opening providing access to said platform and the person reclining thereon from outside of said unit.

4. The structure of claim 3 further comprising:

a closure for said opening, said closure being capable of selective opening and closing.

5. The structure of claim 3 wherein said closure is at least partially translucent.

6. The structure of claim 1 further comprising:

a table connected to an interior surface within said vertical cell, said table being collapsible for conversion to and between a collapsed position for storage and an erected position for use.

7. The structure of claim 6 wherein said interior surface is a wall surface.

8. The structure of claim 7 wherein said interior surface is a wall surface.

9. The structure of claim 1 further comprising:

a chair connected to an interior surface within said vertical cell, said chair being collapsible for conversion to and between a collapsed position for storage and an erected position for use.

10. The structure of claim 1 further comprising:

a mattress on said platform and a storage compartment under said platform.

11. The structure of claim 1 wherein said units are portable.

12. The structure of claim 1 wherein said units are prefabricated.

13. The structure of claim 1 wherein a pair of said units are mated together to form a block, said units being mated such that said horizontal cells of each said unit are vertically aligned with one positioned on top of the other and said vertical cell back walls of said units are juxtaposed to each other.

14. The structure of claim 13 wherein said portion of said horizontal cell side wall of a first said unit juxtaposed to said portion of said vertical cell side wall of a second said unit are each mounted for conversion to and between open and closed positions, said open and closed positions permitting and inhibiting, respectively, access for the person between said vertical cell of said second unit and said horizontal cell of said first unit.

15. The structure of claim 14 wherein said open position blocks said passage between said horizontal and vertical cells of said second unit.

16. The structure of claim 13 wherein a pair of said blocks are mated together to form a grouping, said blocks being mated such that said horizontal cells of a first said block and said horizontal cells of a second said block are on opposite sides of said grouping.

17. The structure of claim 16 further comprising:

a roof positioned atop said grouping.

18. A structure suitable for human habitation comprising:

a generally rectangular, vertically oriented cell, said vertical cell having a back wall spaced from a front wall and a pair of spaced side walls, said vertical cell having an internal volume of sufficient size for a person to stand upright therein;

a generally rectangular, horizontally oriented cell, said horizontal cell having a ceiling spaced from a floor and a pair of spaced side walls, said horizontal cell having an internal volume of sufficient size for the person to recline therein;

a platform in said horizontal cell upon which the person can recline;

said horizontal and vertical cells being connected to form a unit so that a portion of one of said horizontal cell side walls is juxtaposed to a portion of one of said vertical cell side walls;

a passage between said cells through which the person can move to and between said cells;

a doorway and a door on said vertical cell front wall through which the person can enter and exit said unit;

an opening on said horizontal cell side wall opposite from said horizontal cell side wall which is juxtaposed to said vertical cell, said opening providing access to said platform and the person reclining thereon from outside of said unit; and a closure for said opening, said closure being capable of selective opening and closing.

19. The structure of claim 18 wherein said closure is at least partially translucent.

20. The structure of claim 18 further comprising:

a table connected to a wall surface within said volume of said vertical cell, said table being collapsible for conversion to and between a collapsed position for storage and an erected position for use.

21. The structure of claim 18 further comprising:

a chair connected to a wall surface within said volume of said vertical cell, said chair being collapsible for conversion to and between a collapsed position for storage and an erected position for use.

22. The structure of claim 18 further comprising:

a mattress oil said platform and a storage compartment under said platform.

23. The structure of claim 18 wherein said units are portable.

24. The structure of claim 18 wherein said units are prefabricated.

25. The structure of claim 18 wherein a pair of said units are mated together to form a block, said units being mated such that said horizontal cells of each said unit are vertically aligned with one positioned on top of the other and said vertical cell back walls of said units are juxtaposed to each other.

26. The structure of claim 25 wherein said portion of said horizontal cell side wall of a first said unit juxtaposed to said portion of said vertical cell side wall of a second said unit are each mounted for conversion to and between open and closed positions, said open and closed positions permitting and inhibiting, respectively, access for the person between said vertical cell of said second unit and said horizontal cell of said first unit.

27. The structure of claim 26 wherein said open position blocks said passage between said horizontal and vertical cells of said second unit.

28. The structure of claim 25 wherein a pair of said blocks are mated together to form a grouping, said blocks being mated such that said horizontal cells of a first said block and said horizontal cells of a second said block are on opposite sides of said grouping.

29. The structure of claim 28 further comprising:

a roof positioned atop said grouping.

* * * * *